US011718499B2

(12) United States Patent
Simcik

(10) Patent No.: US 11,718,499 B2
(45) Date of Patent: Aug. 8, 2023

(54) CLOUD BASED ELEVATOR DISPATCHING RESOURCE MANAGEMENT

(71) Applicant: Otis Elevator Company, Farmington, CT (US)

(72) Inventor: Paul A. Simcik, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1339 days.

(21) Appl. No.: 16/155,078

(22) Filed: Oct. 9, 2018

(65) Prior Publication Data

US 2020/0109025 A1 Apr. 9, 2020

(51) Int. Cl.
*B66B 1/34* (2006.01)
*B66B 1/28* (2006.01)

(52) U.S. Cl.
CPC ..... *B66B 1/3407* (2013.01); *B66B 1/28* (2013.01); *B66B 1/3423* (2013.01); *B66B 1/3461* (2013.01); *B66B 2201/211* (2013.01); *B66B 2201/402* (2013.01)

(58) Field of Classification Search
CPC ..... B66B 1/3407; B66B 1/28; B66B 1/3423; B66B 1/3461; B66B 2201/211; B66B 2201/402; B66B 1/3446; H04L 67/06; H04L 67/10; H04L 67/30
See application file for complete search history.

(56) References Cited

U.S. PATENT DOCUMENTS

| | | | | |
|---|---|---|---|---|
| 5,616,896 | A * | 4/1997 | Kontturi | B66B 1/2458 187/382 |
| 8,540,057 | B2 | 9/2013 | Schuster et al. | |
| 8,880,200 | B2 | 11/2014 | Nowel | |
| 9,896,305 | B2 | 2/2018 | Blandin et al. | |
| 2016/0107861 | A1 | 4/2016 | Thebeau et al. | |
| 2016/0122157 | A1 | 5/2016 | Keser | |
| 2016/0134686 | A1 | 5/2016 | Youker et al. | |

(Continued)

FOREIGN PATENT DOCUMENTS

| | | |
|---|---|---|
| CN | 103787159 A | 5/2014 |
| CN | 104495536 A | 4/2015 |

(Continued)

OTHER PUBLICATIONS

Office Action dated Jul. 28, 2021 for Chinese Application No. 201910949188.7.

(Continued)

*Primary Examiner* — Jeffrey Donels
(74) *Attorney, Agent, or Firm* — Cantor Colburn LLP

(57) ABSTRACT

Provided are techniques for performing cloud-based elevator dispatching resource management. The techniques include receiving usage information of one or more elevators of an elevator system, obtaining configuration parameters of a controller configured to control the one or more elevators, and analyzing a performance of the one or more elevators based at least in part on the usage information. The techniques also include dynamically updating the configuration parameters of the controller based on the performance and the usage information, storing the configuration parameters and corresponding performance, and operating the one or more elevators based at least in part on the updated configuration parameters.

16 Claims, 4 Drawing Sheets

(56) References Cited

U.S. PATENT DOCUMENTS

| | | | | |
|---|---|---|---|---|
| 2016/0251199 | A1 | 9/2016 | Kronkvist et al. | |
| 2016/0304312 | A1 | 10/2016 | Thompson | |
| 2016/0355375 | A1 | 12/2016 | Simcik et al. | |
| 2017/0137255 | A1 | 5/2017 | Simcik et al. | |
| 2018/0346282 | A1* | 12/2018 | Simcik | B66B 3/006 |
| 2018/0346283 | A1* | 12/2018 | Scoville | B66B 1/2458 |
| 2019/0016560 | A1* | 1/2019 | Ginsberg | B66B 1/28 |
| 2019/0026445 | A1* | 1/2019 | Ginsberg | H04L 9/0894 |
| 2020/0241482 | A1* | 7/2020 | Sinha | G06N 3/0454 |

FOREIGN PATENT DOCUMENTS

| | | | |
|---|---|---|---|
| CN | 105523450 | A | 4/2016 |
| CN | 106276459 | A | 1/2017 |
| CN | 106315320 | A | 1/2017 |
| CN | 104986634 | B | 3/2017 |
| CN | 106586753 | A | 4/2017 |
| CN | 106672733 | A | 5/2017 |
| CN | 106966242 | A | 7/2017 |
| CN | 107128759 | A | 9/2017 |
| CN | 105540361 | B | 11/2017 |
| CN | 105800401 | B | 12/2017 |
| CN | 107522052 | A | 12/2017 |
| CN | 107651517 | A | 2/2018 |
| CN | 107697762 | A | 2/2018 |
| CN | 107738964 | A | 2/2018 |
| CN | 107814280 | A | 3/2018 |
| CN | 105923476 | B | 4/2018 |
| CN | 108217352 | A | 6/2018 |
| CN | 106006248 | B | 11/2018 |
| CN | 111017663 | A | 4/2020 |
| EP | 2421783 | B1 | 8/2015 |
| EP | 3640180 | A1 | 4/2020 |
| JP | 2011235984 | A | 11/2011 |
| WO | 2014200464 | A1 | 12/2014 |

OTHER PUBLICATIONS

European Search Report; European Application No. 19202302.6; Filed: Oct. 9, 2019; dated Mar. 19, 2020; 7 pages.

* cited by examiner

CLOUD BASED ELEVATOR DISPATCHING RESOURCE MANAGEMENT

BACKGROUND

The embodiments herein relate to elevator systems, and more particularly to cloud-based elevator dispatching resource management.

Elevators provide a convenient and efficient way to transport cargo and passengers between floors of a building. Elevators can be initially configured to operate according to a first set of parameters based on the intended use of the building and items that are transported on the elevators. The elevators may experience peak operating times where a higher volume of passengers are using the elevators. However, as the tenants of the building or the use of the building changes over time, the initial configuration for the elevator system may not be optimal for the building's new customers.

BRIEF SUMMARY

According to an embodiment, a system for performing cloud-based elevator dispatching resource management is provided. The system includes a controller that is configured with configuration parameters to control the operation of one or more elevators of an elevator system, wherein the controller is configured to collect usage data from the one or more elevators, wherein the controller is configured to transmit the usage data to a server; the server coupled to the controller, wherein the server is configured to receive and analyze the usage data associated with the operation of the one or more elevators, wherein the server is configured to determine optimized configuration parameters for operating the one or more elevators based at least in part on analyzing the usage data; and wherein the controller is configured to receive the determined optimized configuration parameters from the server and the controller is configured to operate the one or more elevators based at least in part on the determined optimized configuration.

In addition to one or more of the features described herein, or as an alternative, further embodiments include a user device operably coupled to the server that is configured to send a request to the server, wherein the request is associated with the one or more elevators.

In addition to one or more of the features described herein, or as an alternative, further embodiments include a server that includes at least one of a dispatcher parameter optimization module, performance evaluation module, and reduced service level module.

In addition to one or more of the features described herein, or as an alternative, further embodiments include a server that is configured to store at least one of usage data, current profile data, a scheduled for configuration parameter updates, and service scenarios.

In addition to one or more of the features described herein, or as an alternative, further embodiments include a server that is configured to determine a schedule to update the configuration parameters of the controller based on the usage data for one or more elevators.

In addition to one or more of the features described herein, or as an alternative, further embodiments include usage data including data indicating a maximum usage period and an average usage period for the one or more elevators.

In addition to one or more of the features described herein, or as an alternative, further embodiments include dispatcher parameters including at least one of idle parking floors for the one or more elevators or door timing delays for the one or more elevators.

In addition to one or more of the features described herein, or as an alternative, further embodiments include a gateway, wherein the gateway operably couples the elevator system, the user device, and the server.

According to another embodiment, a method for performing cloud-based elevator dispatching resource management is provided. The method includes receiving usage information of one or more elevators of an elevator system; obtaining configuration parameters of a controller configured to control the one or more elevators; analyzing a performance of the one or more elevators based at least in part on the usage information; dynamically updating the configuration parameters of the controller based on the performance and the usage information; storing the configuration parameters and corresponding performance; and operating the one or more elevators based at least in part on the updated configuration parameters.

In addition to one or more of the features described herein, or as an alternative, further embodiments include usage information that indicates an average waiting time and maximum waiting time for each of the one or more elevators.

In addition to one or more of the features described herein, or as an alternative, further embodiments include dispatcher parameters that include at least one of idle parking floors for the one or more elevators or door timing delays for the one or more elevators.

In addition to one or more of the features described herein, or as an alternative, further embodiments include updating the configuration parameters based at least in part on a schedule based at least in part on the usage information.

In addition to one or more of the features described herein, or as an alternative, further embodiments include a schedule that includes one or more periods based on the usage information, and the configuration parameters for the one or more periods determined for the one or more periods based on the performance and usage information of the one or more elevators during each of the one or more periods.

In addition to one or more of the features described herein, or as an alternative, further embodiments include receiving a request to reduce the operation of one or more elevator; receiving configuration parameters for reduced operation; and operating the one or more elevators according to the reduced the modified operation.

In addition to one or more of the features described herein, or as an alternative, further embodiments include storing at least one of usage information, current profile data, and a schedule for configuration parameter updates for the one or more elevators.

In addition to one or more of the features described herein, or as an alternative, further embodiments include receiving a request for at least one of modifying an operation of the one or more elevators, simulating an analysis for the one or more elevators, and reporting a performance of the one or more elevators.

In addition to one or more of the features described herein, or as an alternative, further embodiments include generating a report based at least in part on the performance of the one or more elevators responsive to the performance being less than a performance threshold.

Technical effects of embodiments of the present disclosure include dynamically performing dispatcher optimization and resource management based on the elevator usage data.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Elevator systems include one or more elevator controllers to control the operation of the elevators of the system. One of the tasks of the controller includes a destination dispatch operation. The destination dispatch module can be configured to control the operation of the elevator including the elevators idle parking level, door opening and closing delays, the sequence of servicing elevator calls, etc.

Elevator control systems are configured with an initial set of configuration parameters to control the elevator behavior during a contract period where the dispatcher settings are based upon a full group of operating elevators. The configuration parameters are set for the initial design of building layout and expected usage. For example, an elevator system including six elevators in a 20-story building is designed and configured to operate in a manner that minimizes passenger delay while transporting the passengers between the 20 floors. The dispatching parameters of the elevator controller can be configured to achieve the desired result. For example, by strategically selecting the parking floors for idle elevators and a timer associated with closing the elevator doors the passenger delay can be reduced. However, the passenger delay can be increased when one or more elevators of a multi-elevator system are taken out-of-service. Also, the use of a building can change over time compared to when the elevator system was installed due to tenants and businesses moving in and out of the building. The elevator usage can also change throughout the course of a day where different usage patterns can be determined such as periods of peak traffic and relatively low use. The techniques described herein provide for performing a dynamic analysis and update of dispatcher settings to provide optimal parameter configurations as the usage of the elevators changes throughout the day and over time.

In one or more embodiments the desired performance can be based on agreed contracted service levels. The actual performance of the elevator system can be compared to the desired performance and the result of the comparison can be used to modify the current parameters to achieve a more optimal performance.

The techniques described herein provide for determining the current parameters of the elevator controller and current usage of the elevators. The techniques described herein also provide for dynamically updating the dispatching parameters to improve the performance of the elevator system. The techniques described herein can provide for dispatcher optimization and resource management cloud service. In addition, the techniques described herein can provide for resource management in the event one or more elevators cars are taken out-of-service by modeling current usage patterns and the reduced number of operational elevators.

Figure 1:
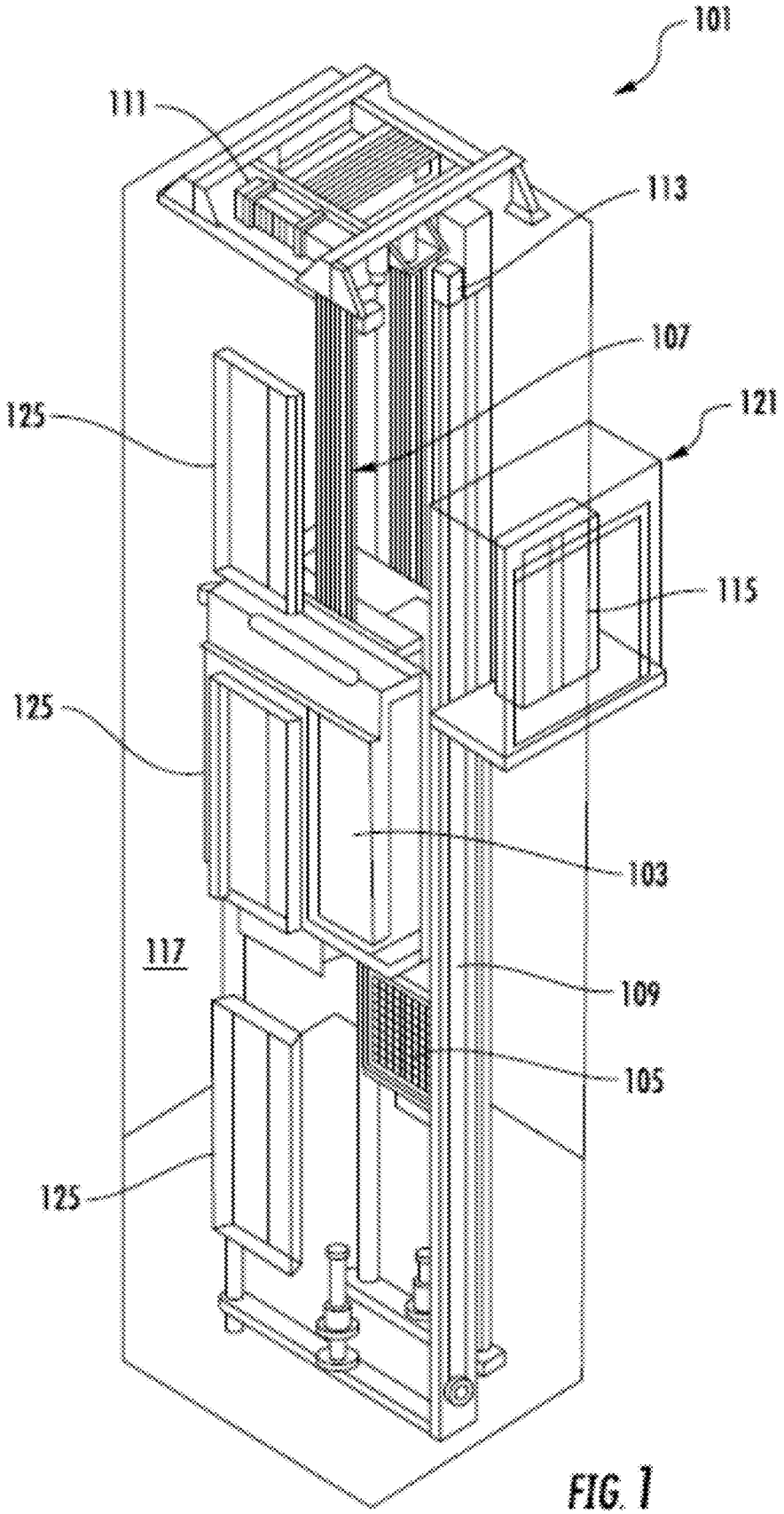
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
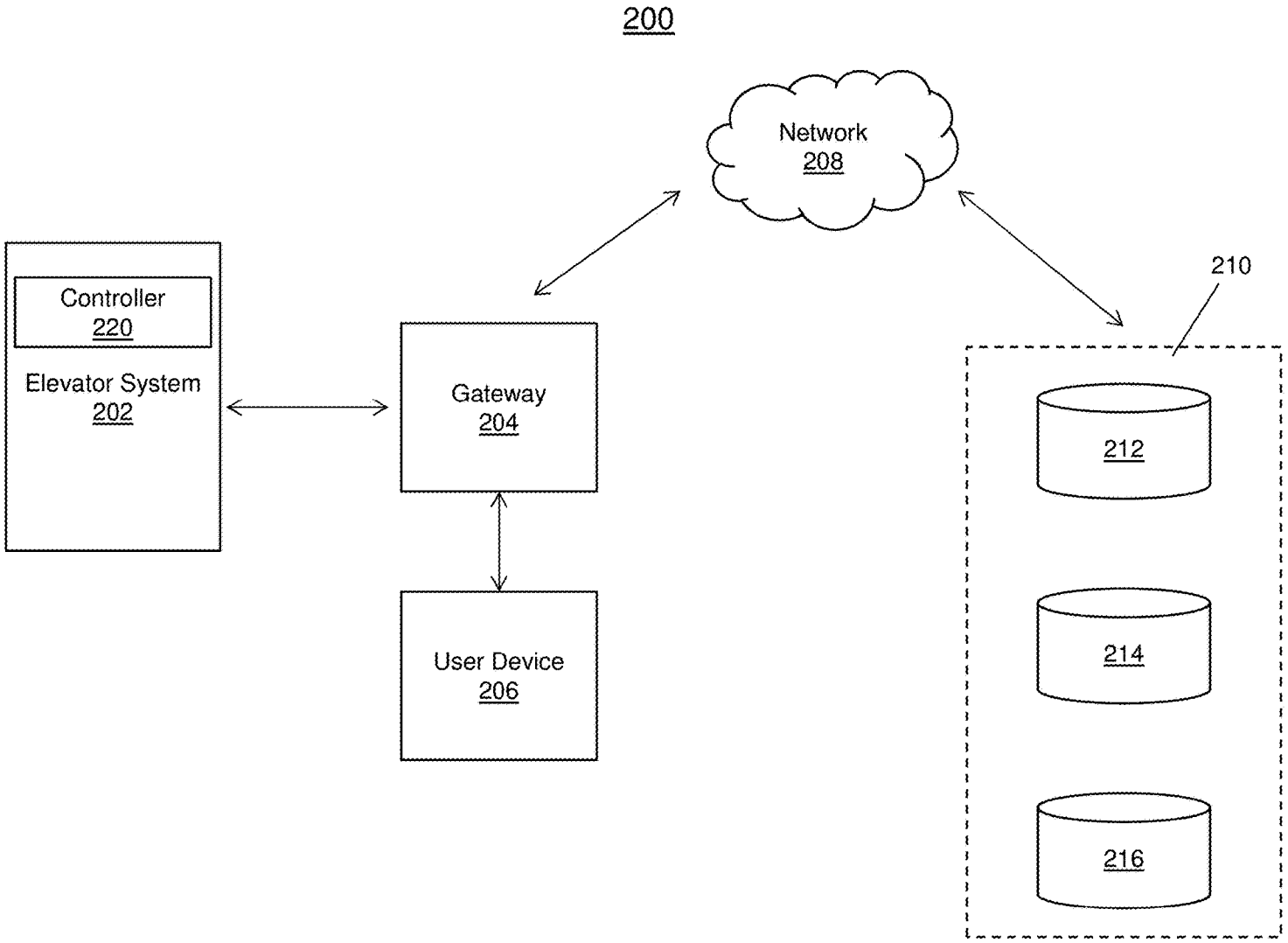
FIG. 2 depicts a system implementing cloud-based elevator dispatching resource management in accordance with one or more embodiments.

In FIG. 2, a system 200 for performing a cloud-based dispatcher optimization and resource management in accordance with one or more embodiments is shown. The system 200 can include an elevator system 202 which can include the elevator system 101 shown in FIG. 1. The elevator system 202 can include a controller 220 which controls the operation of the elevator system 202 and can transmit the data to a cloud server 210 through a gateway 204 of the cloud network 208. In one or more embodiments, the gateway 204 relays data between the network 208, elevator system 202, and user device 206. It should be understood that the gateway 204 can be configured to communicate with other devices such as access points, hubs, user devices, etc. and is not limited to the example provided in FIG. 2. In one embodiment, the gateway 204 may be part of the controller 220. In one embodiment, the gateway 204 may be separate from the controller 220.

The user device 206 can be a mobile device such as a smart device, mobile phone, tablet, etc. In one or more embodiments, the user device 206 can be used to provide a performance report to the cloud server 210. The user device 206 can also be used to request a performance evaluation or request a change in service level such as reducing the number of elevator cars that are in service or bringing elevators back online that have been offline for maintenance.

In one or more embodiments, the request or command is transmitted to the gateway 204 which forwards the message to the cloud server 210 for processing through the cloud network 208. It should be understood the user device 206 can communicate with the cloud network 208 over a wired/wireless connection. The wireless communication can include but is not limited to a cellular connection, Wi-Fi connection, Bluetooth connection, or other types of connections. The cloud network 208 includes multiple components to provide processing and performance analysis.

In one or more embodiments, the cloud server 210 of the cloud network 208 can perform dispatcher optimization and resource management based on the current elevator usage. A cloud server 210 can include one or more components to perform various functions such as a dispatcher parameter module 212, a performance evaluation module 214, and a reduced service level evaluation module 216. It should be understood that other modules can be included in the cloud server 210 to provide additional functionality to the system. The cloud server 210 is configured to perform dispatcher parameter optimization based on the current elevator usage.

The current usage of the elevators can be monitored by an elevator system 202. The elevator usage information can provide the building full-life usage history. The elevator usage information can include average waiting time for a passenger, maximum waiting time for the passenger, etc. The waiting time can be calculated based on the time the passenger places an elevator call and the time the elevator arrives. The usage information can also include the amount of time it takes for the elevator doors to close. The elevator usage information that is collected by the elevator system 202 can be provided to the cloud server 210 and analyzed to determine peak elevator usage periods. In addition, other periods indicating a heavier than average usage can be determined.

The cloud server 210 is also configured to store dispatcher parameters that are used by the elevator controller to control the elevator system 202. The parameters can include values related to the idle distribution of elevators for the parking floors and how long doors remain open, car call sequencing, and other parameters that impact the elevator performance. It should be understood that other parameters of the dispatching controller can be modified to improve the performance of the elevator operation. In some embodiments, an operator or administrator can input specific dispatcher parameter values to configure the elevator operation. Alternatively, the parameter optimization can be achieved by simulation and/or modeling methods to identify the optimal parameters. These parameter settings are configured through a network connection between the cloud server 210 and the elevator system 202.

The cloud server 210 is configured to evaluate the elevator performance on a periodic interval or the evaluation can be performed according to a request from an operator. In one or more embodiments, the performance of the elevator can be compared to the desired performance of the elevator such as that provided in the service contract. Based on the comparison the configuration parameters can be modified.

The evaluation can analyze the usage information based on a given set of dispatcher parameters in different configurable periods. For example, the evaluation can be used to determine the peak operating times for the one or more elevators. The evaluation can monitor elevator usage during a morning period, a lunch period, and an evening period. Other periods or combinations of periods can be used to analyze the usage data of the building.

The performance evaluation, given a set of configuration parameters, can determine the average passenger waiting time and maximum waiting time after a user places an elevator call. The expected waiting time can be compared to the actual waiting time to adjust the configuration parameters to reduce the waiting time experienced by the passengers. In addition, based on the elevator usage history, the configuration can be periodically updated throughout the day to increase the performance. For example, the door closing delay and/or parking floors can be modified during peak hours and the configurations can be returned to the previous or default configurations during non-peak hours. The configuration parameters of the controller can be dynamically updated without operator intervention.

The cloud server 210 is configured to perform reduced service level evaluation. In an elevator system having six elevator cars, for example, if a single car is taken out-of-service, the reduced number of cars will be required to manage the current load of passengers. In other words, a reduced number of cars will be tasked with transporting the same number of passengers. The predicted performance can be determined by performing a simulation with the current controller settings. The simulation can be performed prior to taking the elevator cars offline.

In one or more embodiments, the configuration parameters can be pre-determined using the current usage information for the elevator system. In one or more embodiments, if the expected performance is satisfactory and meets the desired requirements set by the service contract/operator the configuration parameters can be provided to the controller for use during operation. If not, the cloud server 210 can perform additional analysis using modified configuration parameters to meet the performance requirements.

In one or more embodiments, the usage data is collected by the controller and transmitted to a cloud network to perform further analysis. The analysis can be performed by the cloud server 210 offline. In other embodiments, the analysis can be performed in real-time during the operation of the elevator system. The dispatcher configuration parameters and the usage information can be periodically re-evaluated in the cloud server 210 to determine the expected performance based on the dispatcher parameters and the usage information. For example, the periodic evaluation can be performed every 3 months, 6 months, etc.

In one or more embodiments, the cloud server 210 can create a profile for the one or more elevators and store the performance information corresponding configuration parameters. In addition, the profile can store any updated performance information and configuration parameters which can provide a history of the elevator's performance. The cloud server can store a schedule to update the configuration parameters that can provide different configuration parameters based on the time of day such as periods of the morning, lunch and evening rush. In another example, different configuration parameters can be provided based on the day of the week such as if a Monday is historically busier than a Friday the configuration parameters can be different.

Figure 3:
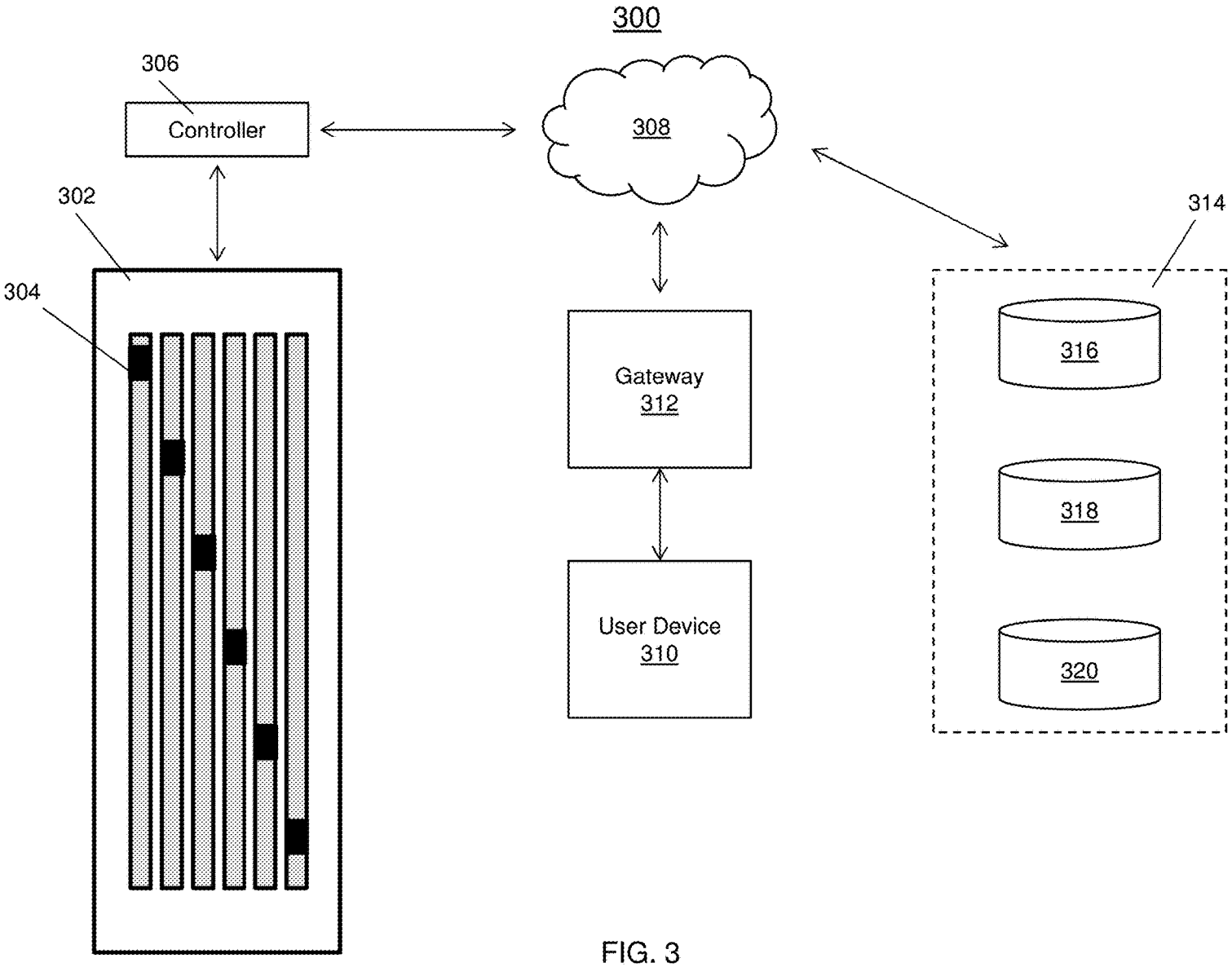
FIG. 3 depicts a multi-elevator system in accordance with one or more embodiments.

In FIG. 3 a multi-elevator system 300 in accordance with one or more embodiments is shown. In an example, the multi-elevator system 300 as shown in FIG. 3 includes a building 302 having a plurality of elevators 304. Although six elevators are shown it should be understood that any number of elevators 304 servicing any number of floors can be used.

The controller 306 is operably coupled to the plurality elevators 304 to control the operation of the elevators 304 and to collect operational data from the elevators 304. The elevator controller 306 can include a memory that can be configured with dispatcher configuration parameters to control the operation of the elevators 304 such as parking floor determination and door closing delays. In one embodiment, a single controller 306 may control all of the elevators 304. In one embodiment, each elevator 304 may have its own controller 306. In one embodiment, any desired number of controllers 306 may be used.

The user device 310 can be used to send a request to the system 300 to report an issue, to modify service, request an evaluation, etc. The request and/or commands can be transmitted to the controller 306 and the cloud server 314 through the gateway 312. Similar to the cloud server 210 of FIG. 2, the cloud server 314 includes one or more components to perform various functions such as a dispatcher parameter module 316, a performance evaluation module 318, and a reduced service level evaluation module 320. In this non-limiting embodiments, the reduced service level evaluation module 320

In an elevator system 300 having six elevator cars, for example, if a single car is taken out-of-service, the reduced number of elevator cars will be required to manage the passenger load. The predicted performance can be determined by performing a simulation with the current controller parameters. In another embodiment, a plurality of settings can be analyzed to predict the most optimal performance, where the parameters having the best performance can be selected.

In one or more embodiments, the cloud server 314 can perform the analysis by reducing one or more elevators cars 304 from service in advance of the elevator being taken out-of-service. In the event that one or more elevators need to be taken offline, an operator can select the number of elevators to take out-of-service based on the predicted performance. The dispatcher configuration parameters values associated with the performance can be provided to the controller 306 to configure the operation of the elevators 304.

Figure 4:
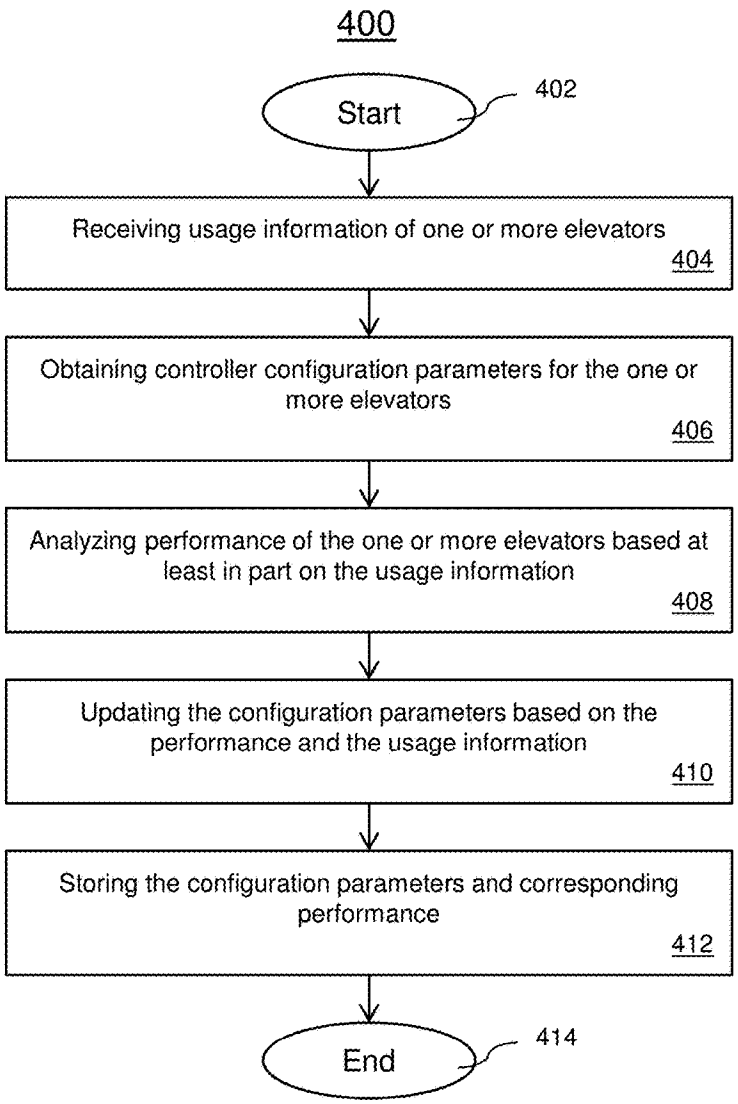
FIG. 4 depicts a flowchart of a method for performing cloud based elevator dispatching resource management in accordance with one or more embodiments.

In FIG. 4, a flowchart of a method 400 for performing a cloud-based dispatcher optimization and resource management is shown. The method 400 can be implemented in any of the systems shown in FIGS. 1-3. It should also be understood that other systems can be used to implement the method 400. The method 400 begins at block 402 and proceeds to block 404 which provides for receiving usage information of one or more elevators. In one or more embodiments, the elevator controller 306 can monitor the operation of the elevators 304 and the elevator controller 306 can transmit the data to the cloud server 314 for further analysis. At block 406, the method 400 provides for obtaining controller configuration parameters for the one or more elevators. The cloud server 314 can obtain the dispatcher configuration parameters.

Block 408 provides for analyzing a performance of the one or more elevators based at least in part on the usage information. In one or more embodiments, the cloud server 314 simulates/models the expected performance with different configuration parameters. The results of the simulation/model are used to identify a new set of configuration parameters to optimize the actual performance of the group of elevators in the building. The results from block 408 are provided to block 410 for further processing.

Block 410 provides for updating the configuration parameters based on the performance and the usage information. In one or more embodiments, the configuration parameters can be updated according to a schedule based on the usage patterns of the elevator system. The method 400 at block 412 provides for storing the configuration parameters and corresponding performance. The configuration parameters and the corresponding performance can be stored in the cloud server 314 and can be used to generate profile information for the elevators 304. Finally, the one or more elevators are operated according to the updated configuration parameters The method 400 ends at block 414.

The technical effects and benefits include minimizing the use of elevators through improved dispatcher parameter configuration settings. The technical effects and benefits also include reducing wasted elevator travel with improved parking floor determination for the one or more elevators. The technical effects and benefits include reducing the impact on passenger waiting time during elevator interruption. The technical effects and benefits also include automatically generating alerts if the performance levels degrade below target levels and transmitting the reports to service support. The technical effects and benefits include processing remote requests to analyze current elevator performance. The technical effects and benefits can include implementing a dynamic operation of the elevators without operator intervention.

In other embodiments, the system comprises a conveyance system that moves passengers between floors and/or along a single floor. Such conveyance systems may include escalators, people movers, etc. Accordingly, embodiments described herein are not limited to elevator systems, such as that shown in FIG. 1.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A system comprising:

a controller configured with configuration parameters to control the operation of one or more elevators of an elevator system, wherein the controller is configured to collect usage data from the one or more elevators, wherein the controller is configured to transmit the usage data to a server;

the server coupled to the controller, wherein the server is configured to receive and analyze the usage data associated with the operation of the one or more elevators, wherein the server is configured to determine optimized configuration parameters for operating the one or more elevators based at least in part on analyzing the usage data; and wherein the controller is configured to receive the determined optimized configuration parameters from the server and the controller is configured to operate the one or more elevators based at least in part on the determined optimized configuration;

wherein the usage data comprises data indicating a maximum usage period and an average usage period for the one or more elevators.

2. The system of claim 1, wherein the configuration parameters comprise dispatcher parameters including at least one of idle parking floors for the one or more elevators or door timing delays for the one or more elevators.

3. The system of claim 1, further comprising a gateway, wherein the gateway operably couples the elevator system, the user device, and the server.

4. The system of claim 1 further comprising:

a user device operably coupled to the server, configured to send a request to the server, wherein the request is associated with the one or more elevators.

5. The system of claim 1, wherein the server includes at least one of a dispatcher parameter optimization module, performance evaluation module, and reduced service level module.

6. The system of claim 1, wherein the server is configured to store at least one of usage data, current profile data, a scheduled for configuration parameter updates, and service scenarios.

7. The system of claim 6, wherein the server is configured to determine a schedule to update the configuration parameters of the controller based on the usage data for one or more elevators.

8. A method for performing cloud-based elevator dispatching resource management, the method comprising:

receiving, by a processor, usage information of one or more elevators of an elevator system;

obtaining configuration parameters of a controller configured to control the one or more elevators;

analyzing a performance of the one or more elevators based at least in part on the usage information;

dynamically updating the configuration parameters of the controller based on the performance and the usage information;

storing the configuration parameters and corresponding performance; and operating the one or more elevators based at least in part on the updated configuration parameters;

wherein the usage information indicates an average waiting time and maximum waiting time for each of the one or more elevators.

9. The method of claim 8 further comprising:

receiving a request from a user device, wherein the request is associated with the one or more elevators.

10. The method of claim 8, wherein the configuration parameters comprise dispatcher parameters including at least one of idle parking floors for the one or more elevators or door timing delays for the one or more elevators.

11. The method of claim 8, further comprising updating the configuration parameters based at least in part on a schedule based at least in part on the usage information.

12. The method of claim 8, further comprising storing at least one of usage information, current profile data, and a schedule for configuration parameter updates for the one or more elevators.

13. The method of claim 8, further comprising receiving a request for at least one of modifying an operation of the one or more elevators, simulating an analysis for the one or more elevators, and reporting a performance of the one or more elevators.

14. A method for performing cloud-based elevator dispatching resource management, the method comprising:

receiving, by a processor, usage information of one or more elevators of an elevator system;

obtaining configuration parameters of a controller configured to control the one or more elevators;

analyzing a performance of the one or more elevators based at least in part on the usage information;

dynamically updating the configuration parameters of the controller based on the performance and the usage information;

storing the configuration parameters and corresponding performance;

operating the one or more elevators based at least in part on the updated configuration parameters; and receiving a request from a user device, wherein the request is associated with the one or more elevators;

updating the configuration parameters based at least in part on a schedule based at least in part on the usage information;

wherein the schedule includes one or more periods based on the usage information, and the configuration parameters for the one or more periods determined for the one or more periods based on the performance and usage information of the one or more elevators during each of the one or more periods.

15. A method for performing cloud-based elevator dispatching resource management, the method comprising:

receiving, by a processor, usage information of one or more elevators of an elevator system;

obtaining configuration parameters of a controller configured to control the one or more elevators;

analyzing a performance of the one or more elevators based at least in part on the usage information;

dynamically updating the configuration parameters of the controller based on the performance and the usage information;

storing the configuration parameters and corresponding performance;

operating the one or more elevators based at least in part on the updated configuration parameters;

receiving a request to reduce the operation of one or more elevator;

receiving configuration parameters for reduced operation; and operating the one or more elevators according to the reduced operation.

16. A method for performing cloud-based elevator dispatching resource management, the method comprising:

receiving, by a processor, usage information of one or more elevators of an elevator system;

obtaining configuration parameters of a controller configured to control the one or more elevators;

analyzing a performance of the one or more elevators based at least in part on the usage information;

dynamically updating the configuration parameters of the controller based on the performance and the usage information;

storing the configuration parameters and corresponding performance;

operating the one or more elevators based at least in part on the updated configuration parameters; and generating a report based at least in part on the performance of the one or more elevators responsive to the performance being less than a performance threshold.

* * * * *